US005246547A

United States Patent [19]

Finck et al.

[11] Patent Number: 5,246,547

[45] Date of Patent: Sep. 21, 1993

[54] HYDROPHOBIC POLYELECTROLYTE COAGULANTS FOR THE CONTROL OF PITCH IN PULP AND PAPER SYSTEMS

[75] Inventors: Martha R. Finck, Countryside; Carol S. Greer, Lisle; Manian Ramesh, Naperville, all of Ill.

[73] Assignee: Nalco Chemical Company, Naperville, Ill.

[21] Appl. No.: 913,153

[22] Filed: Jul. 14, 1992

[51] Int. Cl.[5] ..... D21H 17/45

[52] U.S. Cl. ..... 162/164.6; 162/181.6; 162/199; 162/DIG. 4

[58] Field of Search ..... 162/164.6, 168.7, 181.6, 162/181.8, 199, DIG. 4

[56] References Cited

U.S. PATENT DOCUMENTS

| | | | |
|---|---|---|---|
| 4,734,473 | 3/1988 | Fong et al. | 526/263 |
| 4,769,432 | 9/1988 | Fong | 526/291 |
| 4,802,992 | 2/1989 | Fong et al. | 210/709 |
| 4,913,775 | 4/1990 | Langley et al. | 162/164.3 |
| 4,964,955 | 10/1990 | Lamar et al. | 162/DIG. 4 |
| 4,968,435 | 11/1990 | Neff et al. | 210/734 |
| 5,006,596 | 4/1991 | Chen et al. | 524/555 |
| 5,152,903 | 10/1992 | Neff et al. | 210/734 |

*Primary Examiner*—W. Gary Jones
*Assistant Examiner*—Dean Tan Nguyen
*Attorney, Agent, or Firm*—Ailes, Ohlandt & Greeley

[57] ABSTRACT

A method for controlling pitch in papermaking systems which comprises the step of adding a hydrophobic polyelectrolyte copolymer coagulant to pulp and paper process water. The hydrophobic polyelectrolyte copolymer coagulant comprises diallyldimethylammonium chloride and a hydrophobic monomer selected from the group consisting of: quaternized dimethylaminoethylacrylates and quaternized dimethylaminoethylmethacrylates.

6 Claims, 3 Drawing Sheets

HYDROPHOBIC POLYELECTROLYTE COAGULANTS FOR THE CONTROL OF PITCH IN PULP AND PAPER SYSTEMS

The present invention relates generally to the use of novel hydrophobic polyelectrolyte compositions as coagulants for the control of pitch in pulp and paper mills. These polyelectrolyte compositions are preferably hydrophobically modified copolymers of diallyldimethylammonium chloride (DADMAC) and either dimethylaminoethylacrylate (DMAEA) or dimethylaminoethylmethacrylate (DMAEM).

BACKGROUND OF THE INVENTION

Pitch in a papermaking system can be simply defined as the sticky, resinous material that is released from wood during the pulping process. In paper mill process waters, pitch exists as an unstable, colloidal dispersion of hydrophobic particles. Under the conditions often encountered in a papermaking system, such as hydrodynamic and mechanical shear forces, abrupt pH and temperature changes and exposure to water hardness ions and inorganic scale deposits, colloidal pitch particles tend to agglomerate and deposit on paper machine surfaces.

Pitch deposits often lead to quality defects in the finished paper product, shortened equipment life, impaired system operation, paper machine downtime and, ultimately, lost profits for the mill. These problems are magnified when a paper mill "closes up" its process water system, as many mills have already done for conservation and environmental reasons, thus eliminating many potential exit points for pitch in the system. A closed, recirculating papermaking process water system only has a limited holding capacity for hydrophobic materials like pitch. Unless these pitch particles are continuously removed from the system in a controlled manner, spontaneous system purges can occur which lead to pitch deposits and runnability problems. Thus, the control of pitch deposition in a papermaking system is a priority for many papermakers.

A number of pitch deposit control methods are used in the paper industry. For example, optimizing the performance of the pulp washing stages (e.g., kraft brown stock washers and bleach plant extraction stages) through the application of pitch dispersants and defoamers or washaids to these stages is a control option for many mills. The removal of pitch through these viable exit points is especially important in closed papermaking systems. The use of pitch adsorbants such as talc is often employed; however, unless the talc/pitch particles are effectively retained in the paper sheet, talc can end up contributing to, rather than solving, the pitch deposit problems.

Alum is a widely used pitch control agent for acid papermaking systems. It acts to attach pitch particles to fibers in a manner analogous to the setting of rosin size. Cationic coagulants promote the attachment of the anionically charged, colloidal pitch particles to fibers and fines through a charge neutralization mechanism. The advantage to using cationic coagulants and alum for pitch control is that pitch is removed from the system in the form of microscopic particles dispersed among the fibers in the finished paper product. Unlike alum, a polymer's cationic charge is not necessarily dependent on the pH of the system, thus cationic polymers can be used effectively in neutral and alkaline paper machines. In addition, cationic polymers remain soluble under normal alkaline papermaking conditions while alum can form insoluble aluminum hydroxide.

The present inventors undertook the task of examining the effects of polymer charge, chemistry and molecular weight for various polymers to determine their performance in controlling pitch in papermaking systems. As such, the present inventors discovered that hydrophobically modified copolymers of DADMAC and DMAEA or DMAEM are good agents for the removal or control of pitch in pulp and paper mill processes. Particularly effective copolymers were diallyldimethylammonium chloride/dimethylaminoethylacrylate benzyl chloride quaternary (DADMAC/DMAEA.BCQ) and diallyldimethylammonium chloride/dimethylaminoethylmethacrylate cetyl chloride quaternary (DADMAC/DMAEM.CCQ).

The present invention also provides many additional advantages which shall become apparent as described below.

SUMMARY OF THE INVENTION

A method for controlling pitch in papermaking systems comprising the step of adding a hydrophobic polyelectrolyte copolymer coagulant to pulp and paper process water. The hydrophobic polyelectrolyte copolymer coagulant comprises diallyldimethylammonium chloride (DADMAC) and a hydrophobic monomer selected from the group consisting of: quaternized dimethylaminoethylacrylates (DMAEA) and quaternized dimethylaminoethylmethacrylates (DMAEM). The coagulant is added to the pulp and paper process water in an amount between about 1 to about 5 pounds per ton of dry pulp, whereby the charges on the surfaces of the pitch are reduced or neutralized which allows the pitch to deposit on the fibers contained within the pulp and paper process water instead of on the surfaces of the papermaking machines.

The quaternized DMAEA and DMAEM monomers may include methyl chloride quaternary (MCQ) or $C_4$ to $C_{20}$ chloride quaternaries. The $C_4$ to $C_{20}$ chloride quaternaries may be either aliphatic (e.g., cetyl chloride quaternary (CCQ)) or aromatic (e.g., benzyl chloride quaternary (BCQ)).

These hydrophobic polyelectrolyte copolymers are preferably made via a semi-batch process. The semi-batch process typically comprises the steps of: adding diallyldimethylammonium chloride to a polymerization reactor vessel in an amount between about 1 to about 19 weight percent; heating the diallyldimethylammonium chloride to a temperature in the range between about 47° C. to about 57° C.; adding a polymer initiator dropwise to the diallyldimethylammonium chloride in an amount between about 0.05 to about 0.4 weight percent; adding a hydrophobic monomer dropwise to the diallyldimethylammonium chloride in an amount between about 3.0 to about 19 weight percent; and heating the mixture of diallyldimethylammonium chloride, polymer initiator and hydrophobic monomer to a temperature in the range between about 47° C. to about 82° C.

Other and further objects, advantages and features of the present invention will be understood by reference to the following specification.

DESCRIPTION OF THE PREFERRED EMBODIMENTS

Figure 1:
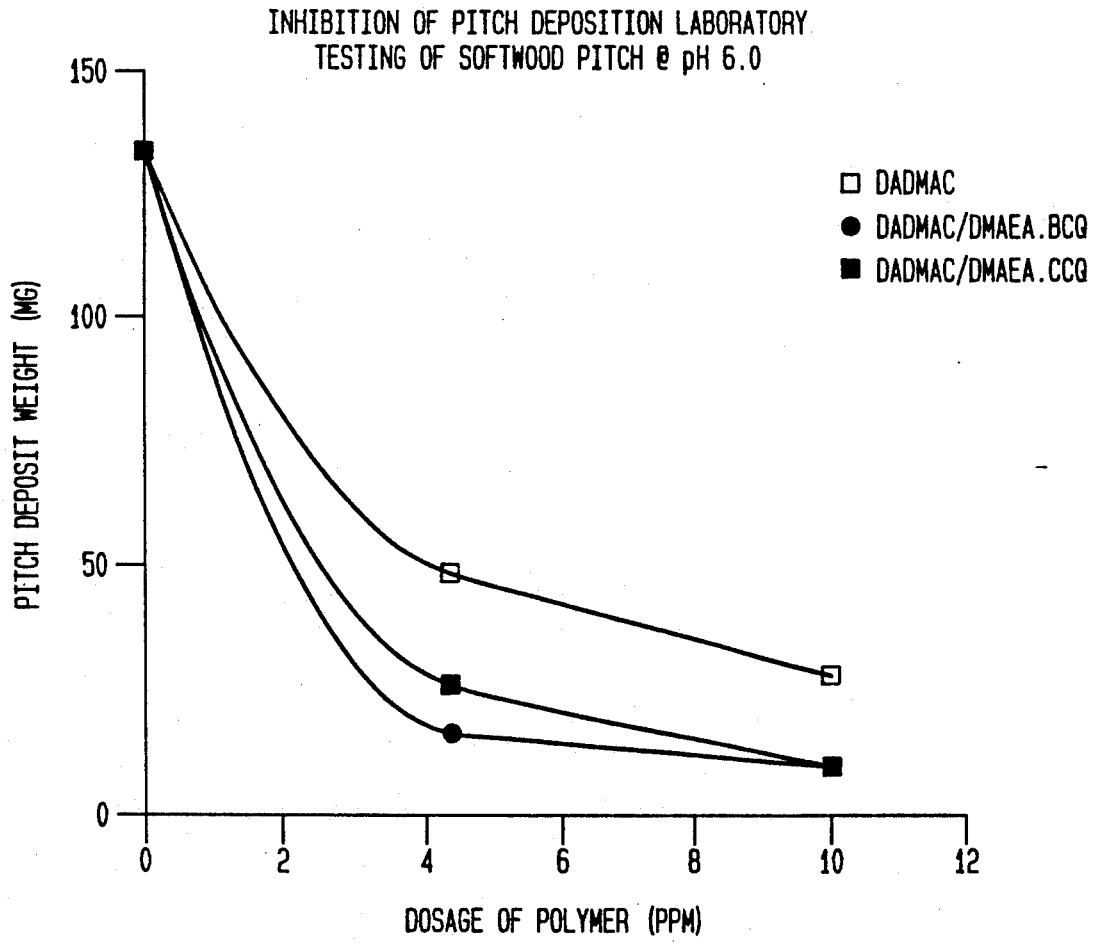
FIG. 1 is a graph plotting pitch deposit weight versus dosage of polymer for poly(DADMAC), DAD- MAC/DMAEA.BCQ (70/30) and DADMAC/DMAEM.CCQ (97/3)

The present inventors have developed a new class of polyelectrolyte copolymer coagulants which exhibit enhanced performance in controlling and/or removing pitch from papermaking systems. These coagulants are hydrophobic copolymers of DADMAC and a hydrophobic monomer such as dimethylaminoethylacrylate benzyl chloride quaternary (DMAEA.BCQ).

It is commonly thought that cationic polymer retention aids act purely by charge neutralization to allow the anionic pitch to deposit on the anionic wood fiber instead of the hydrophobic plastic surface of the headbox and other papermaking machine parts. Pitch is typically formed from fatty acids, sterols, fatty alcohols, alkylesters, and fatty triglycerides. It has been discovered that surface charge neutralization of colloidal pitch in the papermaking process water suspension can be enhanced by the use of a coagulant of poly(DADMAC) or DADMAC which has been modified to incorporate a certain degree of hydrophobic nature. Such a modification can be accomplished by copolymerizing DADMAC with hydrophobic monomers, such as, DMAEA.BCQ, DMAEM.BCQ, DMAEA.CCQ, DMAEM.CCQ, DMAEA.MCQ and DMAEM.MCQ. Moreover, these copolymers are particularly effective in controlling and/or removing pitch when they are prepared via a semibatch technique instead of a batch mode.

This hydrophobic polyelectrolyte copolymer coagulant preferably comprises a diallyldimethylammonium chloride and a hydrophobic monomer. The hydrophobic monomer is at least one monomer selected from the group consisting of: quaternized dimethylaminoethylacrylates and quaternized dimethylaminoethylmethacrylates. DMAEA and DMAEM are preferably quaternized using aliphatic or aromatic $C_4$ to $C_{20}$ chloride quaternaries or methyl chloride quaternaries (MCQ). A preferred aliphatic $C_4$ to $C_{20}$ chloride quaternary is a cetyl chloride quaternary (CCQ) and a preferred aromatic $C_4$ to $C_{20}$ chloride quaternary is benzyl chloride quaternary (BCQ) It is contemplated herein that the term $C_4$ to $C_{20}$ chloride quaternary is generally intended to include both aliphatic and aromatic configurations.

DADMAC can be prepared in accordance with any conventional manner such as the technique described in U.S. Pat. No. 4,151,202 (Hunter et al.), which issued on Apr. 24, 1979, and which is incorporated herein by reference.

The quaternized dimethylaminoethylacrylate is selected from the group consisting of: dimethylaminoethylacrylate methyl chloride quaternary (DMAEA.MCQ) and dimethylaminoethylacrylates having either an aliphatic or aromatic $C_4$ to $C_{20}$ chloride quaternary. The dimethylaminoethylacrylates having aliphatic $C_4$ to $C_{20}$ chloride quaternary is preferably dimethylaminoethylacrylate cetyl chloride quaternary (DMAEA.CCQ) and the preferred aromatic $C_4$ to $C_{20}$ chloride quaternary is dimethylaminoethylacrylate benzyl chloride quaternary.

The quaternized dimethylaminoethylmethacrylate is selected from the group consisting of: dimethylaminoethylmethacrylate methyl chloride quaternary (DMAEM.MCQ) and dimethylaminoethylmethacrylates having aliphatic or aromatic $C_4$ to $C_{20}$ chloride quaternary. The dimethylaminoethylmethacrylates having aliphatic $C_4$ to $C_{20}$ chloride quaternary is preferably dimethylaminoethylmethacrylate cetyl chloride quaternary (DMAEM.CCQ) and the preferred aromatic $C_4$ to $C_{20}$ chloride quaternary is dimethylaminoethylmethacrylate benzyl chloride quaternary (DMAEM.BCQ).

The diallyldimethylammonium chloride and hydrophobic monomer are preferably present in a molar ratio in the range from 20:80 to 99:1.

The unique semi-batch process for making the hydrophobic polyelectrolyte copolymers according to the present invention comprise the following steps:

a. adding diallyldimethylammonium chloride to a polymerization reactor vessel in an amount between about 1 to about 19 weight percent, and purging with nitrogen at a pressure in the range between about 4 to about 6 psig;

b. heating the diallyldimethylammonium chloride to a temperature in the range between about 47° C. to about 57° C.;

c. adding a polymer initiator dropwise to the diallyldimethylammonium chloride in an amount between about 0.05 to about 0.40 weight percent;

d. adding a hydrophobic monomer dropwise to the diallyldimethylammonium chloride in an amount between about 3.0 to about 19.0 weight percent; and e. heating the mixture of diallyldimethylammonium chloride, polymer initiator and hydrophobic monomer to a temperature in the range between about 47° C. to about 82° C., depending upon the particular initiator.

Typically, deionized water is added periodically as needed during the polymerization process in a total amount between about 63 to about 80 weight percent. In some instances it is preferable to mix diallyldimethylammonium chloride with NaCl and deionized water to form a diallyldimethylammonium chloride solution prior to charging it into the reactor vessel. The NaCl is preferably added in an amount between about 2.0 to about 3.5 weight percent and the deionized water is preferably added in an amount between about 1.0 to about 2.5 weight percent. This diallyldimethylammonium chloride solution has a concentration of diallyldimethylammonium chloride in the range between about 54 to about 59.

The diallyldimethylammonium chloride, polymer initiator and hydrophobic monomer are heated at a temperature in the range between about 47° C. to about 57° C. for a period of between about 4 to 5 hours. Thereafter, the temperature of the reactor vessel is increased to about 72° C. to about 82° C. for a period of between about 1 to 4 hours. After polymerization has been completed the copolymer product is typically diluted with deionized water, cooled and stored.

The polymer initiator is selected from the group consisting of 2,2'-azobis(2-amidinopropane) hydrochloride (Vazo(50)), ammonium persulfate, 2,2'-azobis(N,N'-dimethylene isobutylamide) dihydrochloride, and ammonium persulfate/sodium meta bisulfite.

The coagulant is typically added to the papermaking process water suspension in an amount between about 1 to about 5 pounds per ton of dry pulp.

The present invention can best be understood by reference to the below working and comparative examples. The following standard pitch deposition test method was used in evaluating the below examples.

The pH of a bleached hardwood kraft pulp sample made up from dry lap in deionized water (i.e., 500 ml, 1.4% consistency) was adjusted to ~10.6 using dilute 0.1N sodium hydroxide solution. A 1% synthetic pitch solution in isopropanol (i.e., 100 ml, 1653 ppm) was added to the pulp sample, which was then stirred briefly by hand. A 0.5M calcium chloride dihydrate solution (i.e., 5 ml, 413 ppm as $CaCO_3$) was added, and the pulp mixture stirred by hand briefly and gently so as not to precipitate any pitch. If necessary, the pH of the test pulp was then adjusted to 6.0 or any other desired test pH with 0.1N HCL or 0.1N NaOH. The test pulp was poured into an Osterizer blender container and the pitch control agent to be tested was added at this point. A pre-weighed polytetrafluoroethylene coupon was immersed in the test pulp and the latter mixed in the blender for four minutes. The coupon now coated with deposited pitch was removed, gently rinsed to remove any fibers but not pitch adhering to the surface, and dried. The original weight of the coupon was subtracted from the weight of the coupon plus deposited pitch in order to obtain the pitch deposit weight. The percent inhibition of pitch deposition was calculated according to the following equation:

$$\% \text{ Inhibition} = \frac{(\text{Avg. Control})_{PDW} - (\text{Treated})_{PDW}}{\text{Avg. Control}} \times 100$$

where PDW=pitch deposit weight (mg).

The synthetic pitch compositions (hardwood and softwood) used in the pitch deposition tests were comprised of common wood pitch components. Solutions of these synthetic pitch compositions were added to the laboratory pulps to form a colloidal pitch dispersion similar to real wood pitch in actual papermaking pulps, only at a higher effective concentration, so that in the pitch deposition test a measurable pitch deposit could be obtained from a relatively small quantity of pulp in a reasonably short time period. The synthetic pitch compositions typically include the following components:

| SYNTHETIC PITCH COMPOSITIONS: | |
|---|---|
| Abietic Acid (a resin acid) | 5-50% |
| Oleic Acid | 10-25% |
| Palmitic Acid | 5-10% |
| Corn Oil | 10-35% |
| Oleyl Alcohol | 2.5-7.5% |
| Methyl Stearate | 5-15% |
| β-Sitosterol | 2.5-7.5% |
| Cholesteryl Caproate | 2.5-7.5% |

EXAMPLE 1

Two dimethylaminoethylacrylate benzyl chloride quaternary/DADMAC copolymers were evaluated versus a conventional pitch control agent of poly(-DADMAC), a 20% active polymer. Sample 1 was a copolymer formed from 70% DADMAC and 30% DMAEA.BCQ with 20% active polymer and an intrinsic viscosity of 1.4 dl/g. Sample 2 was a copolymer formed from 90% DADMAC and 10% DMAEA.BCQ with 26% active polymer and an intrinsic viscosity of 2.9 dl/g.

Figure 2:
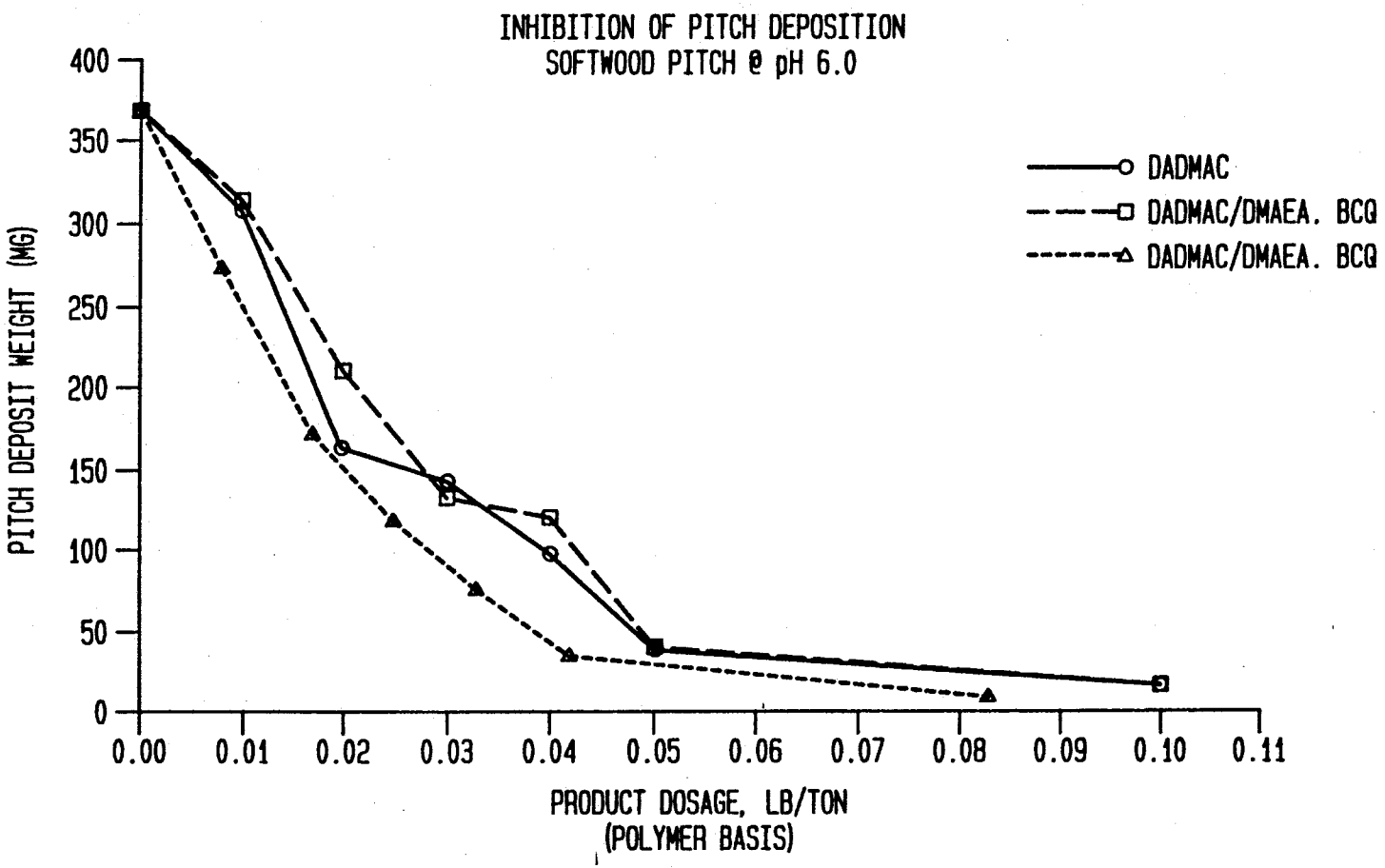
FIG. 2 is a graph plotting pitch deposit weight versus dosage of polymer for poly(DADMAC), DADMAC/DMAEA.BCQ (70/30) and DADMAC/DMAEA.BCQ (90/10)

Pitch deposition test results indicated that the two hydrophobically modified copolymer coagulants were essentially equal to poly(DADMAC) in activity at all treatment dosages. The experimental data is shown in Table 1 below and FIG. 2, attached hereto.

TABLE 1

| PRODUCT | DOSAGE (LB/TON) ACTIVES BASIS | PITCH DEPOSIT WEIGHT (MG) | % INHIBITION OF PITCH DEPOSITION |
|---|---|---|---|
| Control (1) | 0 | 367 | |
| Control (2) | 0 | 381 | |
| Poly(DADMAC) | 0.01 | 308 | 17 |
| Poly(DADMAC) | 0.02 | 163 | 56 |
| Poly(DADMAC) | 0.03 | 142 | 62 |
| Poly(DADMAC) | 0.04 | 97 | 74 |
| Poly(DADMAC) | 0.05 | 38 | 90 |
| Poly(DADMAC) | 0.10 | 16 | 96 |
| Control (3) | 0 | 358 | |
| Sample 1 | 0.01 | 315 | 15 |
| Sample 1 | 0.02 | 211 | 43 |
| Sample 1 | 0.03 | 132 | 64 |
| Sample 1 | 0.04 | 119 | 68 |
| Sample 1 | 0.05 | 40 | 89 |
| Sample 1 | 0.10 | 14 | 96 |
| Control (4) | 0 | 364 | |
| Sample 2 | 0.008 | 275 | 26 |
| Sample 2 | 0.017 | 174 | 53 |
| Sample 2 | 0.025 | 119 | 68 |
| Sample 2 | 0.033 | 77 | 79 |
| Sample 2 | 0.042 | 36 | 90 |
| Sample 2 | 0.083 | 10 | 97 |
| Control (5) | 0 | 380 | |
| Control (6) | 0 | 371 | |

EXAMPLE 2

Two dimethylaminoethylmethacrylate benzyl chloride quaternary/DADMAC copolymers were evaluated versus a conventional pitch control agent of poly(-DADMAC), a 20% active polymer. Sample 1 was a copolymer formed from 70% DADMAC and 30% DMAEA.BCQ With 20% active polymer and an intrinsic viscosity of 1.4 dl/g. Sample 2 was a copolymer formed from 90% DADMAC and 10% DMAEM.BCQ with 26% active polymer and an intrinsic viscosity of 2.9 dl/g. The experimental data is shown in Table 2 below.

TABLE 2

| PRODUCT | DOSAGE (LB/TON) ACTIVES BASIS | PITCH DEPOSIT WEIGHT (MG) | % INHIBITION OF PITCH DEPOSITION |
|---|---|---|---|
| Control (1) | 0 | 367 | |
| Control (2) | 0 | 381 | |
| Poly(DADMAC) | 0.01 | 308 | 17 |
| Poly(DADMAC) | 0.02 | 163 | 56 |
| Poly(DADMAC) | 0.03 | 142 | 62 |
| Poly(DADMAC) | 0.04 | 97 | 74 |
| Poly(DADMAC) | 0.05 | 38 | 90 |
| Poly(DADMAC) | 0.10 | 16 | 96 |
| Control (3) | 0 | 358 | |
| Sample 1 | 0.01 | 315 | 15 |
| Sample 1 | 0.0.2 | 211 | 43 |
| Sample 1 | 0.0.3 | 132 | 64 |
| Sample 1 | 0.04 | 119 | 68 |
| Sample 1 | 0.05 | 40 | 89 |
| Sample 1 | 0.10 | 14 | 96 |
| Control (4) | 0 | 364 | |
| Sample 2 | 0.008 | 275 | 26 |
| Sample 2 | 0.017 | 174 | 53 |
| Sample 2 | 0.025 | 119 | 68 |
| Sample 2 | 0.033 | 77 | 79 |

TABLE 2-continued

| PRODUCT | DOSAGE (LB/TON) ACTIVES BASIS | PITCH DEPOSIT WEIGHT (MG) | % INHIBITION OF PITCH DEPOSITION |
|---|---|---|---|
| Sample 2 | 0.042 | 36 | 90 |
| Sample 2 | 0.083 | 10 | 97 |
| Control (5) | 0 | 380 | |
| Control (6) | 0 | 371 | |

Pitch deposition test results indicated that the coagulant of Sample 1 was essentially equal to poly(DADMAC) in activity at all treatment dosages. The coagulant of Sample 2 demonstrated higher percent inhibition of pitch deposition at lower dosages than poly(DADMAC). All of the hydrophobic polyelectrolyte copolymer coagulants resulted in ~90% inhibition of pitch deposition.

EXAMPLE 3

Two hydrophobic polyelectrolyte copolymer coagulants, i.e., a DADMAC/DMAEA.BCQ copolymer and a DADMAC/DMAEM.CCQ copolymer, were evaluated versus a conventional poly(DADMAC) pitch control agent.

Pitch deposition test results indicated that the two hydrophobically modified copolymer coagulants performed slightly better at higher dosages than did the poly(DADMAC). The experimental data is shown in FIG. 1, attached hereto.

EXAMPLE 4

A hydrophobic polyelectrolyte copolymer was formed from 95% diallyldimethylammonium chloride (DADMAC) and 5% dimethylaminoethylmethacrylate cetyl chloride quaternary (DMAEM.CCQ) monomers. The following reagents were used:

| | |
|---|---|
| 250.62 grams | 62% Solution of DADMAC |
| 150.00 grams | 20% Solution of DMAEM.CCQ |
| 0.30 grams | Versene |
| 10.00 grams | Adipic Acid |
| 15.00 grams | 25% Solution of Ammonium Persulfate |
| 75.08 grams | Deionized Water |

DADMAC was added to a mixture of DMAEM.CCQ, adipic acid, versene, and deionized water. This reaction mixture was then heated to about 50° C. and thereafter the ammonium persulfate was added. The reactor vessel was purged with nitrogen and stirred at about 250 rpm. After 30 minutes a precipitate began to form so an additional 154.76 grams of a 62% solution of DADMAC, 10 grams of a 25% solution of ammonium persulfate and 0.10 grams of versene were added to the reactor vessel. Thereafter, the temperature of the mixture was increased to 65° C. for 6 hours and then cooled to ambient temperature. The final molar ratio of DADMAC to DMAEM.CCQ was 96.68% to 3.32%.

EXAMPLE 5

A hydrophobic polyelectrolyte copolymer was formed from 70% DADMAC and 30% dimethylaminoethylacrylate benzyl chloride quaternary (DMAEA.BCQ) monomers. The following reagents were used:

| | |
|---|---|
| 188.03 grams | 62% Solution of DADMAC |

-continued

| | |
|---|---|
| 104.28 grams | 80% Solution of DMAEA.BCQ |
| 0.20 grams | Versene |
| 15.00 grams | 25% Solution of Ammonium Persulfate |
| 692.49 grams | Deionized Water |

DADMAC and 100 grams of deionized water were placed within a polymerization reactor vessel which was purged with nitrogen. Thereafter, the ammonium persulfate was added dropwise to the reactor vessel via a 60 cc syringe pump for 2 hours. Simultaneously, DMAEA.BCQ was added dropwise to the reactor vessel via a 60 cc syringe pump for 2 hours. The DMAEA.BCQ was diluted with 100 grams of deionized water prior to being loaded into the syringe pump. Thereafter, the remaining deionized water and versene were added to the reactor vessel which was then heated at 65° C. for 6 hours.

EXAMPLE 6

A hydrophobic polyelectrolyte copolymer was formed from 70% DADMAC and 30% dimethylaminoethylacrylate benzyl chloride quaternary (DMAEA.BCQ) monomers. The following reagents were used:

| | |
|---|---|
| 188.03 grams | 62% Solution of DADMAC |
| 104.28 grams | 80% Solution of DMAEA.BCQ |
| 0.20 grams | Versene |
| 1.17 grams | Vazo(50) |
| 706.00 grams | Deionized Water |
| 0.32 grams | $H_2SO_4$ |

DADMAC was placed within a polymerization reactor vessel which was purged with nitrogen and stirred at 300 rpm and a torque of 350 dynes-cm. The pH was adjusted by addition of $H_2SO_4$. After 40 minutes the torque gradually rose to 2240 dynes-cm. Thereafter, 100 grams of deionized water was added to the DADMAC which reduced the torque to 850 dynes-cm. This was followed by the dropwise addition of Vazo(50) and DMAEA.BCQ via separate 60 cc syringe pumps for 2 hours. The DMAEA.BCQ was diluted with 100 grams of deionized water. The reactor vessel was then heated at 65° C. for 5 hours. After 2 hours and 20 minutes the torque reached 2920 dynes-cm. 100 grams of deionized water was again added which reduced the torque to 1180 dynes-cm. After 3 hours and 15 minutes another 100 grams of deionized water was added to the polymerizing product. After 5 hours another 100 grams of deionized water was added to the reactor vessel and the temperature was raised to 80° C. for 1 hour. Thereafter, the resulting polymer was diluted with the remaining deionized water, cooled and stored.

EXAMPLE 7

A hydrophobic polyelectrolyte copolymer was formed from 80% DADMAC and 20% dimethylaminoethylmethacrylate cetyl chloride quaternary (DMAEM.CCQ) monomers. The following reagents were used:

| | |
|---|---|
| 188.02 grams | 62% Solution of DADMAC |
| 83.43 grams | 100% Solution of DMAEM.CCQ |
| 0.20 grams | Versene |
| 1.17 grams | Vazo(50) |
| 727.03 grams | Deionized Water |

-continued

| | |
|---|---|
| 0.15 grams | $H_2SO_4$ |

DADMAC was placed within a polymerization reactor vessel which was purged with nitrogen and stirred at 300 rpm. The pH was adjusted by addition of $H_2SO_4$. 150 ml of deionized water was added to the DADMAC. This was followed by the dropwise addition of Vazo(50) and DMAEA.BCQ via separate 60 cc syringe pumps for 2 hours. The DMAEA.BCQ was diluted with 100 grams of deionized water. The reactor vessel was then heated at 65° C. for 4.5 hours. Between 1.5 to 2 hours, 180 ml of deionized water was again added. After 4.5 hours the temperature was raised to 70° C. for 0.5 hours. Thereafter, the resulting polymer was diluted with the remaining deionized water, cooled and stored.

EXAMPLE 8

A hydrophobic polyelectrolyte copolymer was formed using the same technique described in Example 7 above from 80% DADMAC and 20% dimethylaminoethylacrylate benzyl chloride quaternary (DMAEA.BCQ) monomers. The following reagents were used:

| | |
|---|---|
| 227.52 grams | 62% Solution of DADMAC |
| 73.68 grams | 80% Solution of DMAEA.BCQ |
| 0.40 grams | Versene |
| 1.42 grams | Vazo(50) |
| 696.63 grams | Deionized Water |
| 0.35 grams | $H_2SO_4$ |

However, the water was added as needed. Table 3 below sets forth the time of deionized water addition during the semi-batch polymerization process.

TABLE 3

| SPEED OF ROTATION (RPM) | TORQUE (Dynes-cm) | TIME | H2O ADDITION |
|---|---|---|---|
| 200 | 400 | 0 | 0 |
| 200 | 850 | 30 min. | 0 |
| 200 | 1200 | 45 min. | 50 grams |
| 200 | 700 | 45.1 min. | — |
| 200 | 1600 | 1 hr. 10 min. | 50 grams |
| 200 | 1000 | 1 hr. 10.1 min. | — |
| 200 | 1510 | 1 hr. 35 min. | 50 grams |
| 200 | 1200 | 1 hr. 35.1 min. | 50 grams |
| 200 | 650 | 1 hr. 35.2 min. | — |
| 200 | 1500 | 1 hr. 55 min. | — |
| 200 | 1610 | 2 hr. 12 min. | 50 grams |
| 200 | 558 | 2 hr. 12.1 min. | — |

EXAMPLE 9

A hydrophobic polyelectrolyte copolymer was formed from DADMAC and 10% dimethylaminoethylacrylate benzyl chloride quaternary (DMAEA.BCQ) monomers. The following reagents were used:

| | |
|---|---|
| 251.79 grams | 67% Solution of DADMAC |
| 39.13 grams | 80% Solution of DMAEA.BCQ |
| 0.20 grams | Versene |
| 3.36 grams | Vazo(50) |
| 678.00 grams | Deionized Water |
| 27.52 | NaCl |

The following semi-batch procedure was used:

(1) A DADMAC solution was prepared by evaporating a solution comprising: 251.79 grams of a 67% solution of DADMAC, 27.52 grams of NaCl and 16.6 grams of deionized water for 30 minutes.

(2) The polymerization reactor vessel was then purged with nitrogen, stirred at 200 rpm and heated to 57° C.

(3) Then 40 mg of versene were added to the reactor vessel.

(4) 39.13 grams of DMAEA.BCQ were diluted with 15.87 grams of deionized water, then 160 mg of versene were added, stirred and loaded into a 60 cc syringe pump.

(5) 500 grams of water were disposed in an addition funnel adjacent to the reactor vessel and nitrogen sparged continuously.

(6) 1.68 qrams of Vazo(50) were dissolved in 45.16 grams of deionized water and loaded into another 60 cc syringe pump.

(7) At 57° C., 11.7 grams of the Vazo solution from step 6 above were added to the reactor vessel, together with the dropwise addition of the DMAEA.BCQ (8) Additional deionized water was added from time to time as required.

(9) After 5 hours the temperature was raised to 82° C. and 1.68 grams of Vazo(50) was added. The reaction mixture was kept at that temperature for 4 hours.

(10) Thereafter, the resulting polymer was diluted with the remaining deionized water, cooled and stored. The intrinsic viscosity of the resultant copolymer was 2.77 dl/gm and the solvent was 0.125 m $NaNO_3$.

EXAMPLE 10

A hydrophobic polyelectrolyte copolymer was formed from 90% DADMAC and 10% dimethylaminoethylacrylate benzyl chloride quaternary (DMAEA.BCQ) monomers. The following reagents were used:

| | |
|---|---|
| 185.10 grams | 67% Solution of DADMAC |
| 28.77 grams | 80% Solution of DMAEA.BCQ |
| 0.15 grams | Versene |
| 2.48 grams | Vazo(50) |
| 498.42 grams | Deionized Water |
| 20.23 grams | NaCl |

DADMAC, NaCl, and 12.20 grams of deionized water were charged into a reaction vessel and heated to 57° C. in a nitrogen atmosphere. Thereafter, the DMAEA.BCQ and 1.24 grams of Vazo(50) were added dropwise for 4 hours via separate 60 cc syringe pumps to the mixture of DADMAC, NaCl and water. 500 ml of deionized water was taken in an addition funnel, purged with nitrogen, and added from time to time as needed. Thereafter, the versene was added and the reaction vessel was heated at 57° C. for an additional 5 hours. 1.24 grams of Vazo(50) were added and the reaction vessel was heated at 82° C. for 4.5 hours. The resultant polymer product was diluted with the remaining deionized water, cooled and stored. The intrinsic viscosity of the resultant copolymer was 2.97 dl/gm and the solvent was 0.125m $NaNO_3$.

EXAMPLE 11

A hydrophobic polyelectrolyte copolymer was formed from 90% DADMAC and 10% dimethylaminoethylacrylate benzyl chloride quaternary (DMAEA.BCQ) monomers. The following reagents were used:

| | |
|---|---|
| 251.79 grams | 67% Solution of DADMAC |
| 39.13 grams | 80% Solution of DMAEA.BCQ |
| 0.20 grams | Versene |
| 3.36 grams | Vazo(50) |
| 705.52 grams | Deionized Water |

DADMAC and deionized water were charged into a reaction vessel and heated to 57° C. in a nitrogen atmosphere. Thereafter, the DMAEA.BCQ and 1.68 grams of Vazo were added dropwise for 4 hours via separate 60 cc syringe pumps to the mixture of DADMAC and water. 500 ml of deionized water was taken in an addition funnel, purged with nitrogen, and added from time to time as needed. Thereafter, the versene was added and the reaction vessel was heated at 57° C. for an additional 5 hours. 1.68 grams of Vazo were added and the reaction vessel was heated at 82° C. for 4.5 hours. The resultant polymer product was diluted with the remaining deionized water, cooled and stored. The intrinsic viscosity of the resultant copolymer was 2.37 dl/gm and the solvent was 0.125m $NaNO_3$.

EXAMPLE 12

A hydrophobic polyelectrolyte copolymer was formed from 85% DADMAC and 15% dimethylaminoethylacrylate benzyl chloride quaternary (DMAEA.BCQ) monomers. The following reagents were used:

| | |
|---|---|
| 308.35 grams | 72.5% Solution of DADMAC |
| 85.15 grams | 80% Solution of DMAEA.BCQ |
| 0.20 grams | Versene |
| 3.60 grams | Vazo(50) |
| 548.70 grams | Deionized Water |
| 54.00 grams | NaCl |

DADMAC, NaCl, and deionized water were mixed together and heated to 57° C. in a nitrogen atmosphere. Thereafter, the DMAEA.BCQ and 1.80 grams of Vazo were added dropwise for 4 hours via separate 60 cc syringe pumps to the mixture of DADMAC, NaCl and water. 500 ml of deionized water was taken in an addition funnel, purged with nitrogen, and added from time to time as needed. Thereafter, the versene was added and the reaction vessel was heated at 57° C. for an additional 5 hours. 1.80 grams of Vazo were added and the reaction vessel was heated at 82° C. for 4.5 hours. The resultant polymer product was diluted with the remaining deionized water, cooled and stored.

EXAMPLE 13

A 1% solution of hydrophobic polyelectrolyte copolymer formed from 70% DADMAC and 30% dimethylaminoethylacrylate benzyl chloride quaternary (DMAEA.BCQ) monomers and a 1% solution of poly(-DADMAC) were independently added to a synthetic softwood pitch pulp to compare their respective filtrate turbidity at various dosages.

The test was performed by dosing the softwood pitch pulp with either DADMAC/DMAEA.BCQ or poly(-DADMAC) at 100 rpm shear stirring for two minutes, filtering through Reeves Angel 202 filter paper, diluting the filtrate ten-fold, and then measuring the turbidity at 450 nm using the #750 turbidity program on a Hach DR 2000 portable spectrophotometer. The filtrate turbidity measurements are in Formazin Turbidity Units (FTU); this is an absorptometric method where the light source is at 180° from the detector.

The results of the filtrate turbidity tests are set forth below in Table 4 and attached FIG. 3.

| POLYMER | DOSAGE (lb/ton) | FILTRATE TURBIDITY (FTU) |
|---|---|---|
| Poly(DADMAC) | 0.02 | 119 |
| Poly(DADMAC) | 0.05 | 117.5 |
| Poly(DADMAC) | 0.10 | 110.5 |
| DADMAC/DMAEA.BCQ | 0.02 | 120 |
| DADMAC/DMAEA.BCQ | 0.05 | 116 |
| DADMAC/DMAEA.BCQ | 0.10 | 108 |

Figure 3:
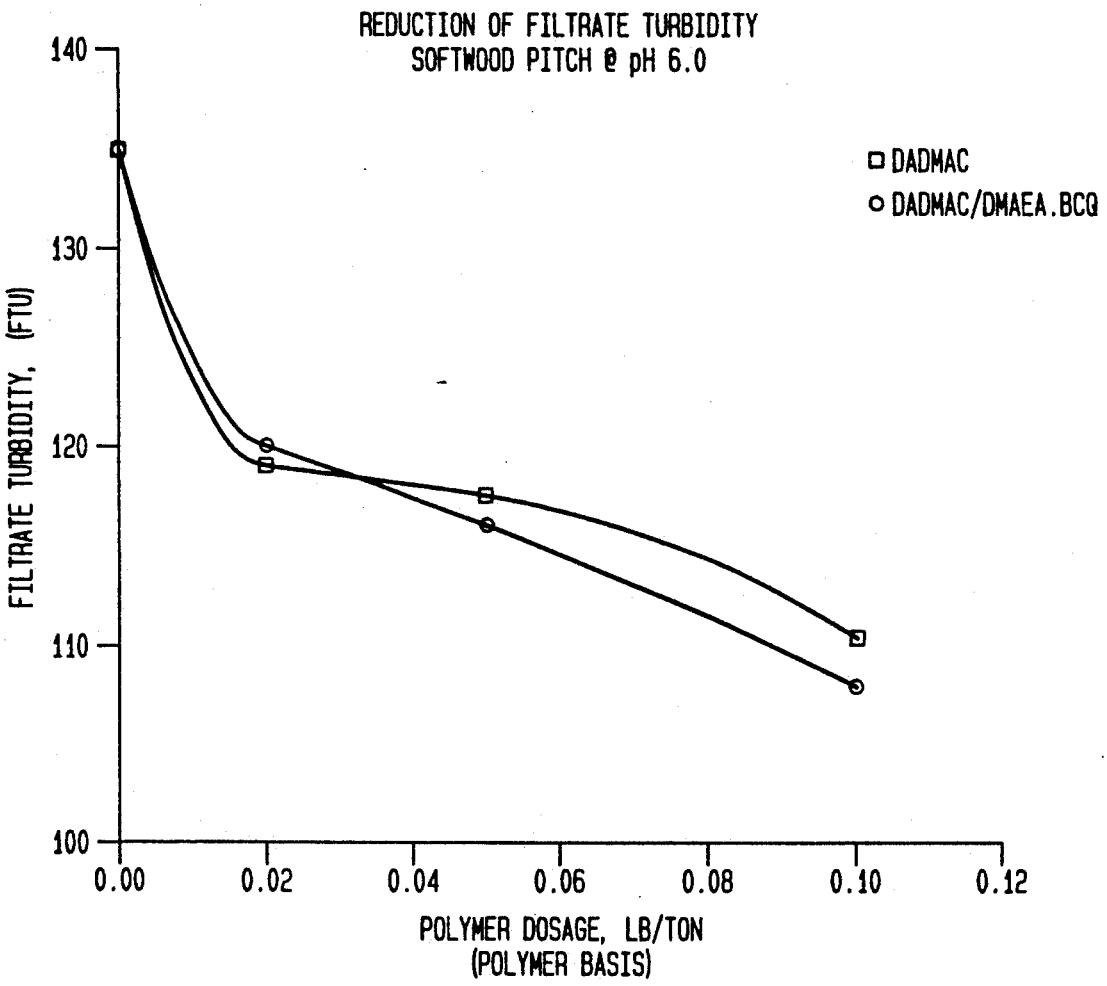
FIG. 3 is a graph plotting filtrate turbidity versus dosage of polymer for poly(DADMAC) and DADMAC/DMAEA.BCQ (70/30).

An improved reduction in pulp filtrate turbidity is seen after treatment with DADMAC/DMAEA.BCQ as compared to poly(DADMAC) as shown in Table 4 above and FIG. 3. A reduction in filtrate turbidity indicates an efficient removal of colloidal pitch from the system by coagulation upon polymer treatment.

While we have shown and described several embodiments in accordance with our invention, it is to be clearly understood that the same are susceptible to numerous changes apparent to one skilled in the art. Therefore, we do not wish to be limited to the details shown and described but intend to show all changes and modifications which come within the scope of the appended claims.

What is claimed is:

1. A method for controlling pitch in papermaking systems which comprises the step of adding a hydrophobic polyelectrolyte copolymer coagulant to pulp and paper process water in an amount between about 0.01 to about 5 pounds per ton of dry pulp, said hydrophobic polyelectrolyte copolymer coagulant comprises diallyldimethylammonium chloride and a hydrophobic monomer selected from the group consisting of: dimethylaminoethylacrylates having $C_6$ to $C_{20}$ chloride quaternary and dimethylaminoethylmethacrylates having $C_6$ to $C_{20}$ chloride quaternary, whereby a percent inhibition of pitch deposition of 15% or greater is achieved.

2. The method according to claim 1 wherein said dimethylaminoethylacrylates having $C_6$ to $C_{20}$ chloride quaternary are either dimethylaminoethylacrylate benzyl chloride quaternary or dimethylaminoethylacrylate cetyl chloride quaternary.

3. The method according to claim 1 wherein said dimethylaminoethylmethacrylates having $C_6$ to $C_{20}$ chloride quaternary are either dimethylaminoethylmethacrylate benzyl chloride quaternary or dimethylaminoethylmethacrylate cetyl chloride quaternary.

4. The method according to claim 1 wherein said diallyldimethylammonium chloride and said hydrophobic monomer are present in a molar ratio in the range from about 20:8 to about 97:3.

5. The method according to claim 1 wherein said hydrophobic polyelectrolyte copolymer coagulant is added to said pulp and paper process water in an amount between about 1 to about 5 pounds per ton of dry pulp.

6. The method according to claim 1 wherein said hydrophobic polyelectrolyte copolymer coagulant is a solution which consists of: water, said diallyldimethylammonium chloride, and said hydrophobic monomer.

* * * * *